United States Patent [19]

Delbrouck

[11] 4,269,326

[45] May 26, 1981

[54] DISPENSING COMPARTMENT, IN PARTICULAR FOR REFRIGERATING UNITS

[76] Inventor: Klaus Delbrouck, Peter von Flistedenstr. 5, 5000 Köln, Fed. Rep. of Germany

[21] Appl. No.: 28,802

[22] Filed: Apr. 10, 1979

[30] Foreign Application Priority Data

Apr. 17, 1978 [DE] Fed. Rep. of Germany ..... 2816547

[51] Int. Cl.[3] ..... A47F 1/12; A47F 3/04

[52] U.S. Cl. ..... 221/227; 221/228; 221/279; 312/71

[58] Field of Search ..... 221/279, 232, 227, 228, 221/229, 150–152, 280; 312/36, 71

[56] References Cited

U.S. PATENT DOCUMENTS

| | | | |
|---|---|---|---|
| 1,205,844 | 11/1916 | Berry | 221/232 X |
| 1,638,181 | 8/1927 | Bell | 221/279 |
| 2,305,348 | 12/1942 | King | 221/279 X |
| 2,446,788 | 8/1948 | Rifkin | 221/279 X |
| 2,522,896 | 9/1950 | Rifkin | 221/279 X |
| 2,893,596 | 7/1959 | Gabrielsen | 221/227 X |
| 3,722,745 | 3/1973 | Gushi | 221/232 X |
| 4,134,520 | 1/1979 | Collins | 221/227 X |

FOREIGN PATENT DOCUMENTS

| | | | |
|---|---|---|---|
| 712054 | 6/1965 | Canada | 312/71 |

*Primary Examiner*—Allen N. Knowles

*Attorney, Agent, or Firm*—Browdy and Neimark

[57] ABSTRACT

A dispensing compartment which is in particular provided for refrigeration units has a substantially horizontal stand surface for a plurality of identical or similarly formed articles and is provided with guide walls or strips at the sides projecting beyond the level of the stand surface as well as with a front abutment wall or strip confining the stand surface at the removal side. In order to achieve a quick and convenient removal and a direct access to the products to be removed, a rear abutment is provided which is shiftable in direction of the removal side and away therefrom and upon which a force acts directed toward the removal side. By this structure, the articles to be removed are always accessible at the removal side, and the articles located therebehind are continuously urged forwardly in the course of further removal by means of the force-activated rear abutment.

10 Claims, 9 Drawing Figures

DISPENSING COMPARTMENT, IN PARTICULAR FOR REFRIGERATING UNITS

Figure 1:
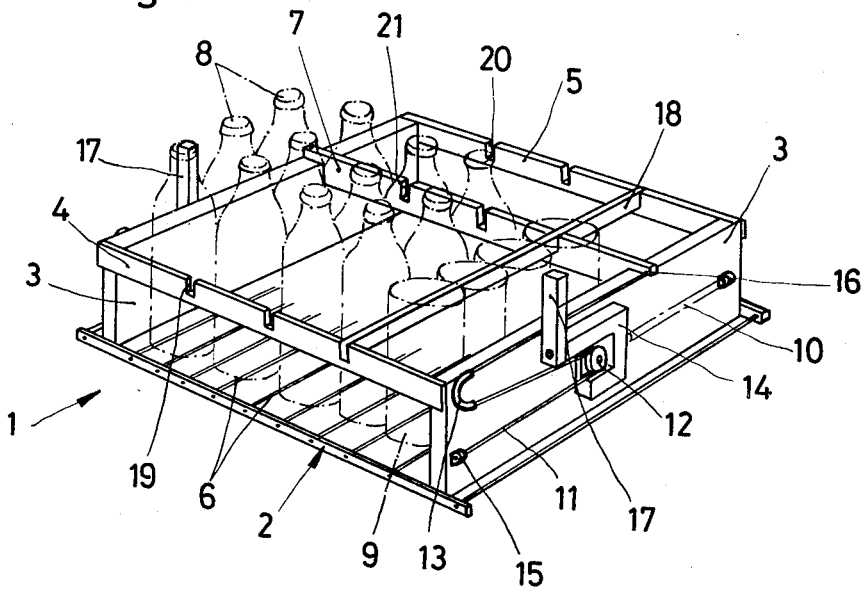

This invention relates to a dispensing compartment, in particular for refrigerating units, including a substantially horizontal stand surface for a plurality of identical or dissimilar articles, lateral guide walls or strips projecting beyond the level of the stand surface as well as a front abutment wall or strip confining the stand surface as the dispensing side.

With table-high storing furniture having a plurality of dispensing compartments at different levels it is frequently difficult to remove the articles disposed in the compartments, in particular in the event they are located at the rear. These problems predominantly occur in refrigerating bars in restaurants, drugstores and the like, where bottled beer and lemonade are stored in the dispensing compartments of the refrigerating bar. In order to remove a bottle, the proprietor must stoop down to the floor and possibly reach far into the compartment and possibly look for a certain sort of bottled beer or lemonade in the stooped position. This not only renders the removal work complicated and time-consuming, but also the door of the refrigerating bar stay open all this time, so that the cold atmosphere is able to escape from the refrigerating bar and thus additional energy must be provided for.

It is an object of the invention to provide a dispensing compartment which permits a quick and convenient removal and a direct access to the products to be removed.

According to the invention, at least a rear abutment is provided which is shiftable in direction to the removal side and away therefrom and is capable of being acted upon by a force acting in direction of the removal side.

The structure according to the invention brings about the advantage that the objects to be removed are always accessible at the removal side and the objects located therebehind are continuously urged forwardly in the course of further removal by means of the force-activated rear abutment. When such a dispensing compartment is used in conjunction with a refrigerating bar, the proprietor when opening the door for instance will find the bottles to be removed at the front side of the compartment so that the removal is permitted with only a short opening period of the door. A deep stooping as required with conventional bars for the removal of bottles from the rear area of the compartment is not necessary. Damages of the articles during removal are also precluded when using the dispensing compartment of this invention, broadly, since the articles are firmly held together by the force-activated abutment, so that they are not able to be upset. When removing an article, the articles positioned therebehind are automatically advanced and again firmly held together in the now restricted stand surface. A further advantage is that the filling is simple and may be effected quickly; for the dispensing compartment may be taken out of the bar and inserted into the bar again in the filled condition. When filling the dispensing compartment, the stand surface may be completely utilized.

The same advantages are also obtained in the event the dispensing compartment is for instance employed in refrigerating boxes of groceries or supermarkets. In this case the cooled articles are always transported forwardly in order to be ready for removal. This prevents that the rear groups always remain at the rear, are covered by newly filled in products and thus are not sold and possibly spoil.

The rear abutment of the dispensing compartment of this invention is preferably defined by a shiftable wall or strip which extends across the entire width of the stand surface. The abutment may be supported at the lateral guide walls or strips.

For exerting a force onto the abutment, tension and/or compression springs may be provided which act upon the abutment indirectly or directly. Preferably, two tension or compression springs arranged at opposite sides are provided which with their one ends are secured to the respective lateral guide wall or strip and with their other ends engage directly or indirectly with the lateral ends of the rear abutment.

In order to be able to use the stand surface to an optimum and have no obstructions at the sides of the guide walls or strips, the tension or compression springs are conveniently arranged at the external side of the lateral guide walls or strips.

Each of the springs serving to exert a force upon the rear abutment may engage at a loose roll or reversing means, a tension rope being passed about said roll in the manner of a tackle, said rope being secured with one end to the respective guide wall or strip, while the other end is passed about a roll or reversing means secured to the guide wall or strip and is connected to the abutment.

A tension spring is preferably used as spring which is secured to the end of the guide wall or strip remote from the removal side, while the stationary roll or reversing means and the attachment point of the tension rope are positioned at the end of the guide wall or strip at the removal end.

For filling the dispensing compartment, the force-activated rear abutment must be pushed rearwardly. In order to be able to hold the abutment in this position, at the bearing block of the loose roll or reversing means a pivotable lever may be arranged which is pivotable with the abutment completely pushed rearwardly for holding the bearing block in front of the frontal side of the dispensing compartment.

In the event the tension spring must be designed extremely strong by virtue of the structural circumstances given, for facilitating a tensioning of the spring when newly filling the compartment a transmission must be provided. Said transmission may be characterized in that at the bearing block of the loose roll a resetting rope is secured, that the resetting rope is passed about a spool secured in the vicinity of the removal side and that the spool is drivable via a manually operated drive wheel coupled thereto and having a larger diameter than the spool. The transmission ratio in this context depends on the diameter relationship between the spool and the drive wheel.

In the event a plurality of strokes are required for tensioning the tension spring, the drive wheel may be connected to the spool via an overrunning clutch, while the spool is arrestable for the resetting operation of the drive wheel.

For operating the drive wheel, a rack may be provided which engages in a tooth arrangement provided at the external side of the drive wheel. As an alternative, for operating the drive wheel also a pulling cord secured to the external perimeter of the drive wheel may be provided. In this case, for resetting the drive wheel between the individual strokes, a resetting spring acting upon the drive wheel may be provided.

In order to permit that the rear abutment when tensioning the tension spring automatically is pushed rearwardly into its rearmost position, a second pull cord may engage with the rear abutment in opposite direction to the first pull cord, the second pull cord passing over a rear stationary roll or reversing means and a second loose roll or reversing means provided at the bearing block to an attachment point positioned at the rear compartment end.

When different articles, for instance beer bottles and lemonade bottles, are to be placed into a dispensing compartment, partitions dividing the stand surface and extending parallel to the lateral guide walls or strips may selectively be inserted. These partitions are inserted in such a way that the abutment is free to shift and is not interfered in its function.

When the dispensing compartment according to the invention is to be used for storing units and in particular for refrigerating furniture having outer doors pivotable at the dispensing side which are pivotable open and closed about an axis disposed in the plane of the stand surface of the compartment or slightly underneath said plane and are arrestable in at least an opened removal or filling position, the front abutment wall or strip may be secured movable to the dispensing compartment and upon opening of the outer door follow the pivot movement thereof or upon closing the outer door return into its starting position. This type of dispensing compartment facilitates the removal materially, for the articles to be removed, for instance cooled bottles, tilt forwardly when the outer door is pivoted open, since the front abutment follows the pivot movement of the outer door so that the articles are available for direct access. On the other hand, thereby the opening period of a refrigerating unit may be reduced for removing a refrigerated article, and finally this type of refrigerator opening opposes a flowing out of cold atmosphere from the refrigerator during removal. By virtue of the easy accessibility, this embodiment is also for instance well suited for drink dispensing wherein the serving person is sitting and possibly serves the cash register simultaneously.

In order to bring the articles to be removed positively into an access position when opening the outer door, the front abutment wall or strip may have an L-shaped cross-section of which the long limb defines the front confinement of the compartment and the short limb extends underneath the plane of the stand surface underneath the front row of the articles positioned in the compartment, the abutment wall or strip being mounted pivotable about a horizontal axis disposed in the plane of the lower L-limb or slightly underneath said plane.

As an alternative, a yoke mounted horizontally shiftable vertical of the pivot axis of the outer door may also be provided as front abutment, the front end position of said yoke being selected in such a way that the articles standing in the compartment in the foremost row are tiltable forwardly by an according angle. The yoke preferably then has in its forward region in which the articles engage therewith a swung shape conformed to the outer shape of the articles.

According to a further embodiment, the front abutment wall or strip may be pivotable about a lower horizontal axis generally disposed in the plane of the stand surface of the compartment forwardly into a predetermined tilted position, the end position thereof being limited.

Figure 2:
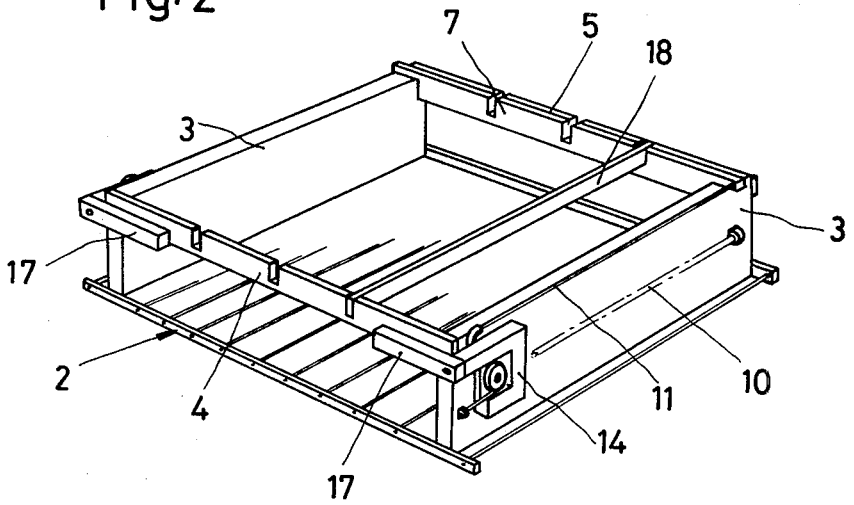
Figure 3:
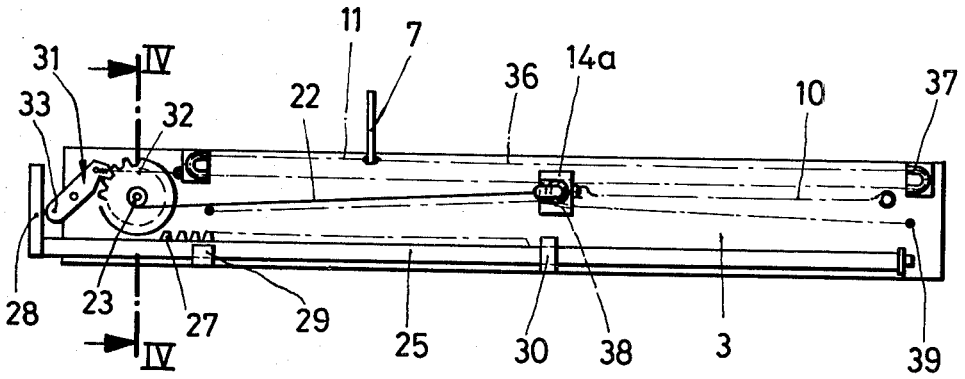
Figure 4:
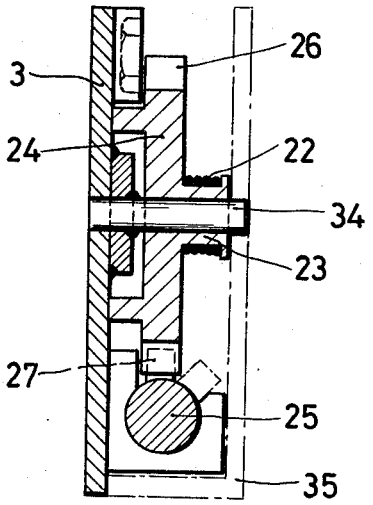
Figure 5:
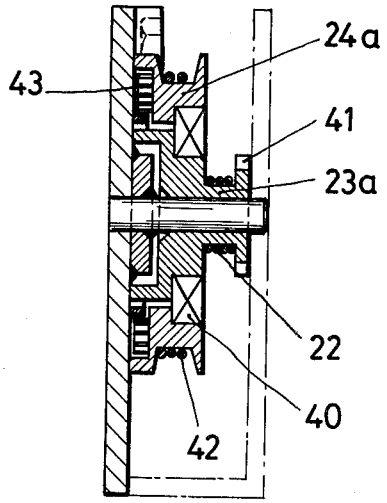
Figure 6:
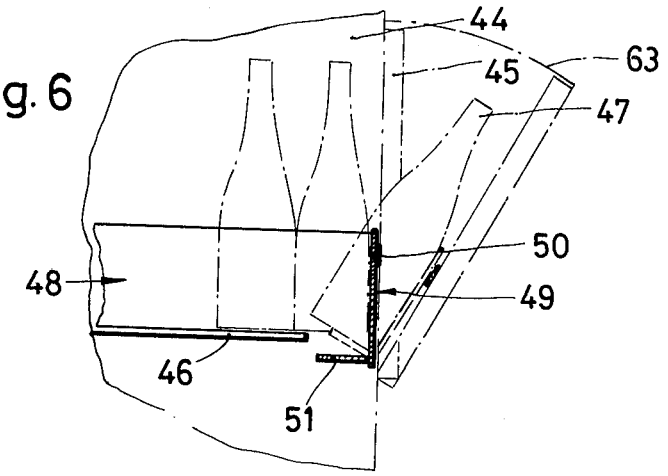
Figure 7A:
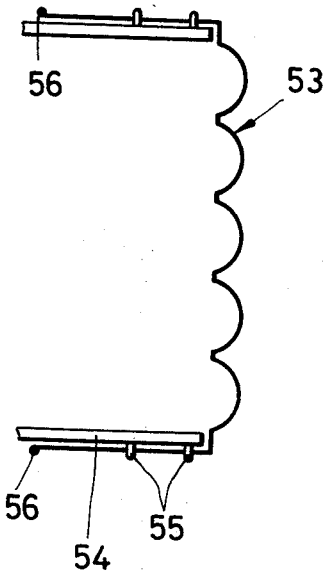
Figure 7B:
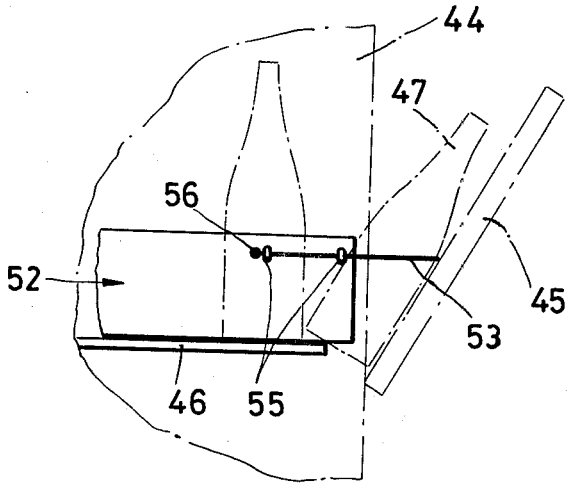
Figure 8:
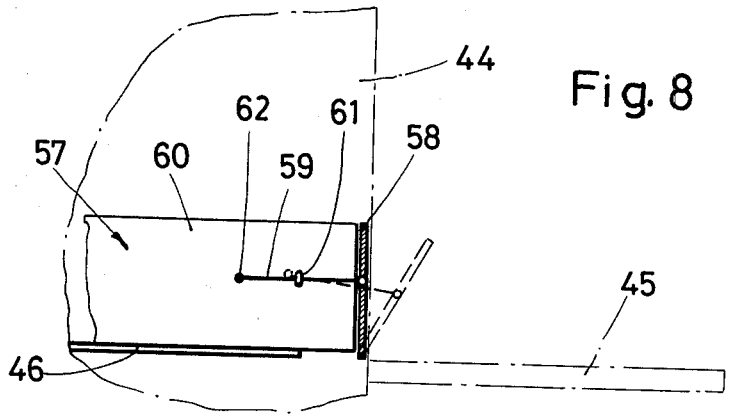

The invention is illustrated in the drawings by way of example and described hereinafter in detail in referring to the drawings. Therein:

FIG. 1 is a perspective view of a dispensing compartment partially filled with bottles and cans, FIG. 2 is the same dispensing compartment with a positioning of the rear abutment directly prior to a refilling of the dispensing compartment, FIG. 3 is a side-elevational view of a further embodiment of the dispensing compartment, FIG. 4 is an illustration to an enlarged scale of a sectional view taken along line IV—IV of FIG. 3, FIG. 5 is the same sectional view as shown in FIG. 4 of a different embodiment of the dispensing compartment, FIG. 6 is a sectional view of the front portion of a dispensing compartment for a storing furniture, in particular refrigerating unit, including a outer pivot door associated to each compartment, FIG. 7*a* is a plan view of the front portion of a further embodiment of a dispensing compartment, FIG. 7*b* is a side-elevational view of the compartment according to FIG. 7*a*, and FIG. 8 is a sectional view of the front portion of a further embodiment of a dispensing compartment.

As illustrated, the dispensing compartment comprises a basket 1 having a lower horizontal stand surface 2, lateral guide walls 3 arranged parallel to one another and projecting beyond the level of the stand surface 2, a front abutment wall 4 confining the stand surface at the removal side as well as a rear terminal strip 5. The lower stand surface is defined by a grid the rods 6 of which extend parallel to the lateral guide walls 3 and thus resist the articles to be shifted on the stand surface with only a low frictional value.

Furthermore, the dispensing compartment has a rear abutment strip 7 which is shiftable in direction to the removal side and away therefrom. The rear abutment strip 7 extends across the entire width of the stand surface 2 and is mounted with its ends slidingly at the two parallel guide walls 3. It may be shifted along the entire depth of the stand surface 2, the shift path being limited at the removal side by the front abutment wall 4 and at the rear side by the terminal strip 5.

In any desired position, the shiftable abutment strip 7 is acted upon by a force acting in direction toward the removal side so that articles 8 and 9 standing in the basket 1 on the stand surface 2 are always urged in direction of the removal side and the articles of the front row engage with the stationary abutment wall 4 at the removal side.

The force activation of the shiftable abutment strip 7 is effected via tension springs 10 which transmit their force via tension ropes 11 to the abutment strip 7. So that the strip 7 is able to be acted upon by the force of the springs 10 along the path of the entire depth of the basket 1, the tension ropes 11 are passed in the manner of a tackle about rolls 12 and reversing means 13 so that for a small spring movement an extended shift path of the abutment strip 7 is achieved.

At the two external sides of the lateral guide walls 3, one tension spring 10 each is provided which is secured with its one end to the end of the guide wall 3 remote from the removal side, while the other end is connected to a bearing block 14 of a loose roll 12. The respective pull rope 11 is likewise secured to the external side of the respective lateral guide wall 3, the attachment point 15 being located at the removal side. The tension rope 11 thus initially extends from the attachment point 15 in direction of the rear region of the basket 1, is then passed about the loose roll 12 and returns back to the removal side, where it is reversed again into the opposite direction to the rear side of the basket 1 about stationary reversing means 13 provided at a distance above the attachment point. The free end 16 of the tension rope 11 is then secured to the respective lateral end of the shiftable abutment strip 7.

The bearing block 14 connected to the respective tension spring 10 upon shifting of the rear abutment strip 7 moves in direction opposite thereto parallel to the lateral guide walls 3. By virtue of the tackle-like arrangement, the bearing block only moves through half the distance which the abutment strip 7 passes. Since the movement of the bearing block corresponds to the stretching variation of the spring 10, the maximum spring path only is required to be equal to half the basket depth in order to respectively exert a force upon the abutment strip along the entire basket depth.

When the rear abutment strip 7 is brought into its rearwardly shifted position for filling the basket 1, in which position it engages the rear terminal strip 5, the bearing block assumes its position shifted furthest in direction of the removal side, in which position the spring 10 experiences its maximum elongation. In order to be able to fill the basket 1 in this position conveniently, without having to hold the rear abutment strip 7 in its position, same is able to be arrested. An arresting is effected in that the bearing block 14 is fixed in its front position so that the rear abutment strip 7 is no longer acted upon by any force. For arresting the bearing block 14, at the front end thereof a pivotable lever 17 is provided which is able to be pivoted in front of the front abutment strip 4 and thus receives the tension force of the spring 10. This position in which the basket is able to be refilled has been illustrated in FIG. 2.

When after filling the basket 1 the abutment strip 7 is to be acted upon by the spring force again, the lever 17 is pivoted from the arresting position illustrated in FIG. 2 into the upwardly directed position illustrated in FIG. 1 so that now the spring force is able to act upon the rear abutment strip 7. When then articles are removed at the removal side from the basket 1, the rear abutment strip 7 urges the remaining articles further forwardly until they engage with the front abutment strip 4 and are there ready for removal.

When articles of different shapes and sorts are to be placed into a dispensing compartment, the stand surface 2 may be divided by a partition strip 18 which is insertible and extends parallel to the lateral guide walls 3. The partition strip 18 may be attached conveniently between the front abutment strip 4 and the rear terminal strip 5 by simply threading it into according slits 19 and 20 which are provided for this purpose in the two strips 4 and 5. Throughout the width of the basket 1, there may be provided a plurality of juxtaposed slits 19 and 20 in the strips 4 and 5 so that either the partition strip 18 is able to be threaded into slits at various places or a plurality of partition strips 18 may be inserted. In order to insure that the rear abutment wall 7 also is able to freely shift even with partition strips 18 inserted, recesses 21 are provided in the abutment strip 7 at the corresponding locations through which the partition strips 18 extend with clearance.

In the embodiment illustrated in FIG. 1, only one partition strip 18 is inserted in a position offset from the center so that the stand surface 2 is divided into two areas of different size. On the larger area of the stand surface, then articles of that group are placed which are more frequently removed, for instance beer bottles 8, while for instance lemonade cans 9 may be placed on the smaller area.

Dispensing compartments of the type described above may be used in conjunction with refrigerating furniture or the like of any desired design. They may be formed as drawers or they may also simply be placed onto existing intermediate shelves so that also a reequipment of existing refrigerating furniture with such dispensing compartments is permitted.

In FIGS. 3 to 5 of the drawings in which the same structural details have been assigned the same reference numerals, alternative designs have been illustrated by means of which a tensioning of the spring 10 is able to be facilitated. In this instance, a resetting cord 22 is secured to the respective external side of the guide walls 3 at the bearing block 14*a*, said cord passing to a spool 23 mounted rotatably in the vicinity of the removal side of the compartment and being able to be spooled thereupon upon a rotation of the spool. According to FIGS. 3 and 4, the spool 23 is firmly connected to a drive wheel 24 which has a generaly four times larger diameter than the spool 23. For driving the drive wheel 24, a rack 25 is provided which engages in teeth 26 provided at the external side of the drive wheel 24. By a movement of the rack 25 in direction of the removal side, the drive wheel 24 and at the same time the spool 23 are moved in such a way that the resetting cord 22 winds up on the spool 23 and thus shifts the bearing block 14*a* in counteraction to the force of the spring 10 toward the removal side so that the abutment 7 is unloaded and is able to be pushed rearwardly. In view of the large transmission ratio, a plurality of strokes of the rack 25 are required in order to bring the bearing block 14*a* into its frontmost position in which the abutment 7 directly engages with the rear compartment side.

For initiating a new stroke of the rack 25, the teeth 27 must be uncoupled. This is done in that the rack formed round is turned by pivoting the hand grip 28 into the position illustrated in FIG. 4 in which the teeth 27 are no longer in engagement with the teeth 26 of the drive wheel 24. In this position, the rack 25 guided in bearings 29 and 30 may be pushed forwardly and rearwardly without the drive wheel 24 being moved and the spool 23 thereby being rotated. In order to prevent that after uncoupling the drive wheel 24 and the spool 23 perform a retrograde movement, a detent 31 is provided which is pulled via a tension spring 32 indicated in FIG. 3 into the respective gap between two teeth 26 of the drive wheel 24 and prevents a retrograde movement of the drive wheel. In the operative condition in which the spool 23 and thus the drive wheel 24 must be rotatable so that the abutment 7 is spring-biased, the detent 31 is automatically pivoted into in ineffective position. This is done in that the hand grip 28 of the rack 25 engages the counterlever 33 of the pivotable detent 31 and lifts it off the teeth 26 of the drive wheel 24.

A stationary axle 34 serves to jointly support the spool 23 and the drive wheel 24, said axle on the one hand being secured at the side wall 3 and on the other hand at a cover plate 35 illustrated in phantom in FIG. 4 and arranged at a distance from the side wall 3.

In order to achieve that the rear abutment 7 upon a forward movement of the bearing block 14*a* automatically is shifted rearwardly, a second pull cord 36 is provided which engages with the abutment 7 in direction opposite to the first tension rope 11 and is passed via a rear stationary reversing means 37 and a second reversing means 38 provided at the bearing block 14*a* to an attachment point 39 positioned at the rear compartment end. Upon a shifting of the bearing block 14*a*, the abutment 7 is thus automatically moved in both directions.

In the embodiment illustrated in FIG. 5, the mechanism formed by the spool 23*a* and the drive wheel 24*a* is of a somewhat different design. In this embodiment, the tension rope secured to the loose bearing block 14*a* similar to the embodiment illustrated in FIGS. 3 and 4 is wound up on the spool 23*a*. However, the spool 23*a* in this embodiment is not secured rigidly to the drive wheel 24*a*, but connected thereto via an overrunning clutch 40 which may for instance be a clamping roller clutch. The detent 31 not illustrated in FIG. 5 must in this embodiment therefore engage the spool 23*a* which for this purpose is provided with teeth 41 at the right-hand side.

A pull cord 42 serves to drive the drive wheel in this embodiment which is wound up on the external perimeter of the drive wheel 24*a*. In order to be able to reset the drive wheel 24*a* after each stroke again into its starting position, a spiral resetting spring 43 is provided which acts in counteraction to the force exerted by the pull cord 42. In this embodiment, the pull cord also could be replaced by a rack as used in the embodiment illustrated in FIGS. 3 and 4. By virtue of the overrunning clutch, however, it would not be required in this embodiment to uncouple the rack after each stroke.

In FIGS. 6 to 8, three embodiments of a dispensing compartment have been illustrated wherein the front abutment wall or strip in contradistinction to the embodiment of FIGS. 1 and 2 is arranged movable. These three embodiments of the dispensing compartment are in particular suited for refrigerating furniture 44 having outer pivot doors 45 which are pivotable open and closed about an axis positioned in the plane of the stand surface 46 of the compartment or slightly underneath this plane. When the outer pivot door 45 is opened, the front bottles 47 which are continuously urged forwardly by the rear force-activated abutment are able to tilt into an inclined position which is inclined by about 30° to the vertical and offers a good access for a removal of the bottles.

In the dispensing compartment 48 illustrated in FIG. 6, the front abutment wall 49 has an L-shaped cross-section of which the long limb 50 defines the front confinement of the compartment 48 and the short limb 51 extends underneath the plane of the stand surface 46 underneath the front row of the bottles 47 standing in the compartment. When the outer pivot door 45 is opened, the L-shaped front abutment wall 49 tilts forwardly and brings the bottles 47 into the inclined removal position. The outer pivot door may also be kept open for an extended period of time, for instance for the entire business hours in which products are sold from the refrigerating unit. In order to prevent a heat exchange as far as possible, the free space between the upper edge of the outer pivot door 45 and the front wall of the unit 44 is closed by an easily removable cover 63. Thereby, a quick access to the articles 47 is permitted without operating the pivot door 45.

In the dispensing compartment 52 illustrated in FIGS. 7*a* and 7*b*, a yoke 53 horizontally shiftable vertical of the pivot axis of the outer door 45 is provided as a front abutment, said yoke being mounted at the external surfaces of the side walls 54 in two eyes 55 located behind one another. At the two ends of the yoke 53, there are thickened portions 56 which engage the eyes 55 when the yoke is pushed forwardly and define the end position of the yoke illustrated in FIG. 7*b*. When the outer pivot door 45 is opened, the bottles 47 tilt forwardly and are then also held by the yoke 53 in the slightly tilted removal position when the outer pivot door 45 is pivoted further open.

In the dispensing compartment 57 illustrated in FIG. 8, the front abutment is formed by a strip or wall 58 which is pivotable about a lower horizontal axis generally disposed in the plane of the stand surface 46 of the compartment forwardly into a predetermined inclined position. The forwardly pivoted end position of the wall 58 is limited by lateral yokes 59 which are guided in eyes 61 provided in the side walls 60 and have thickened portions 62 at their ends, said portions engaging with the eyes 61 in the forwardly pivoted end position. In the embodiments illustrated in FIGS. 7 and 8, the outer pivot door may also be kept open for the desired period of time, the free cross-section being able to be provided in the same way as in the embodiment illustrated in FIG. 6 with a cover.

What is claimed is:

1. In a dispensing compartment for a table-high refrigerating unit accessible only from the removal side, said compartment including a substantial horizontal stand surface extending across the entire width of the compartment and provided for receiving a plurality of identical or similar formed articles, and having lateral guide walls projecting beyond the level of the stand surface as well as a front abutment wall confining the stand surface at the removal side, the improvement wherein at least one shiftable rear abutment is provided, extending across the entire width of the stand surface and being shiftable in directions toward and away from the removal side, means for exerting a force on said shiftable rear abutment acting in the direction of the removal side comprising at least one spring engaged at one end thereof with one of the lateral guide walls and at its other end with a loose roll or reversing means, and a tension rope passed about said roll or reversing means in the manner of a tackle, said rope being secured at one end thereof to the respective guide wall with the other end of said rope being passed about a stationary roll or reversing means secured to the guide wall and connected to said shiftable rear abutment;

wherein the spring is a tension spring which is secured at the end of the guide wall remote from the removal side, while the stationary roll or reversing means and the attachment point of the tension rope are located at the end of the guide wall at the removal side;

wherein said loose roll or reversing means has a bearing block to which is secured a resetting cord, wherein the resetting cord is passed about a spool secured in the vicinity of the removal side and wherein the spool is rotatable via a drivable drive wheel coupled therewith and having a larger diameter than the spool.

2. In a dispensing compartment for a table-high refrigerating unit accessible only from the removal side, said compartment including a substantial horizontal stand surface extending across the entire width of the compartment and provided for receiving a plurality of identical or similar formed articles, and having lateral guide walls projecting beyond the level of the stand surface as well as a front abutment wall confining the stand surface at the removal side, the improvement wherein at least one shiftable rear abutment is provided, extending across the entire width of the stand surface and being shiftable in directions toward and away from the removal side, means for exerting a force on said shiftable rear abutment acting in the direction of the removal side comprising at least one spring engaged at one end thereof with one of the lateral guide walls and at its other end with a loose roll or reversing means, and a tension rope passed about said roll or reversing means in the manner of a tackle, said rope being secured at one end thereof to the respective guide wall with the other end of said rope being passed about a stationary roll or reversing means secured to the guide wall and connected to said shiftable rear abutment;

wherein the spring is a tension spring which is secured at the end of the guide wall remote from the removal side, while the stationary roll or reversing means and the attachment point of the tension rope are located at the end of the guide wall at the removal side;

wherein at the rear abutment a second tension rope engages in direction opposite to the first tension rope and wherein the second tension rope passes via a rear stationary roll or reversing means and a second loose roll or reversing means provided at the bearing block to an attachment point located at the rear compartment end.

3. In a dispensing compartment for a table-high refrigerating unit having an outer pivotable door for each compartment and accessible only from the removal side, said compartment including a substantial horizontal stand surface extending across the entire width of the compartment and provided for receiving a plurality of identical or similar formed articles, and having lateral guide walls projecting beyond the level of the stand surface as well as a front abutment wall confining the stand surface at the removal side, the improvement wherein at least one shiftable rear abutment is provided, extending across the entire width of the stand surface and being shiftable in directions toward and away from the removal side, means for exerting a force on said shiftable rear abutment acting in the direction of the removal side comprising at least one spring engaged at one end thereof with one of the lateral guide walls and at its other end with a loose roll or reversing means, and a tension rope passed about said roll or reversing means in the manner of a tackle, said rope being secured at one end thereof to the respective guide wall with the other end of said rope being passed about a stationary roll or reversing means secured to the guide wall and connected to said shiftable rear abutment;

said door being pivotable open and closed about an axis disposed in the plane of said horizontal stand surface or slightly underneath said plane and at least being arrestable in an open position, wherein the front abutment wall is secured movable to the dispensing compartment and when the outer door is opened follows the pivot movement thereof, and when the outer door is closed returns into its starting position.

4. A dispensing compartment as set forth in claim 3, wherein the shiftable rear abutment is mounted at the lateral guide walls.

5. A dispensing compartment as set forth in claim 3, wherein two of said springs are arranged, one at each opposite side of the compartment.

6. A dispensing compartment as set forth in claim 3, wherein the spring is a tension spring which is secured at the end of the guide wall remote from the removal side, while the stationary roll or reversing means and the attachment point of the tension rope are located at the end of the guide wall at the removal side.

7. A dispensing compartment as set forth in claim 6, wherein said loose roll or reversing means has a bearing block, and a pivotable lever is arranged which, with said shiftable rear abutment completely pushed rearwardly, is arrestable for keeping stationary the bearing block.

8. A dispensing compartment as set forth in claim 3, wherein the front abutment wall has an L-shaped cross section of which the long limb defines the front confinement of the compartment and the short limb extends underneath the plane of the stand surface underneath the front row of the articles positioned in the compartment, and wherein the abutment wall is mounted pivotable about a horizontal axis disposed in the plane of the lower L-limb or slightly underneath said plane.

9. A dispensing compartment as set forth in claim 3, wherein as a front abutment a yoke mounted horizontally shiftable vertical to the pivot axis of the outer door is provided, the front end position of said yoke comprising means to tilt articles standing in the foremost row in the compartment forwardly by an according angle.

10. A dispensing compartment as set forth in claim 3, wherein the front abutment wall is pivotable forwardly into a predetermined inclined position about a lower horizontal axis generally disposed in the plane of the stand surface of the compartment.

* * * * *